US005706549A

United States Patent [19]

Legatt et al.

[11] Patent Number: 5,706,549

[45] Date of Patent: Jan. 13, 1998

[54] ROTARY DISC FLOOR CLEANING APPARATUS

[75] Inventors: Donald J. Legatt, St. Michael; David Wood, Maple Plain, both of Minn.

[73] Assignee: Advance Machine Company, Plymouth, Minn.

[21] Appl. No.: 670,083

[22] Filed: Jun. 25, 1996

[51] Int. Cl.[6] ..... A47L 11/202

[52] U.S. Cl. ..... 15/385; 15/50.1; 15/245; 15/320; 15/401

[58] Field of Search ..... 15/320, 385, 401, 15/245, 49.1, 50.1

[56] References Cited

U.S. PATENT DOCUMENTS

| | | | |
|---|---|---|---|
| 1,211,948 | 1/1917 | Koster et al. . | |
| 1,424,879 | 8/1922 | Carlstedt . | |
| 1,480,662 | 1/1924 | Caine . | |
| 1,498,255 | 6/1924 | Winchester . | |
| 1,627,263 | 5/1927 | Baily . | |
| 1,673,529 | 6/1928 | Ponselle . | |
| 1,766,419 | 6/1930 | Wertz . | |
| 1,821,715 | 9/1931 | Kuchinsky . | |
| 2,168,692 | 8/1939 | Vidal . | |
| 2,495,686 | 1/1950 | Berberian . | |
| 2,680,260 | 6/1954 | Danielsson et al. . | |
| 2,893,037 | 7/1959 | Strong . | |
| 2,953,807 | 9/1960 | Nilsson . | |
| 2,972,770 | 2/1961 | Cronhage . | |
| 3,022,529 | 2/1962 | Bonfanti . | |
| 3,065,490 | 11/1962 | Arones | 15/401 X |
| 3,189,930 | 6/1965 | Tuthill, Jr. . | |
| 3,314,099 | 4/1967 | Otto . | |
| 3,540,072 | 11/1970 | Wolter et al. . | |
| 3,619,848 | 11/1971 | Salzmann | 15/50.1 X |
| 3,623,177 | 11/1971 | Pack . | |
| 3,624,668 | 11/1971 | Krause . | |
| 3,644,960 | 2/1972 | Danzig . | |
| 3,686,707 | 8/1972 | Hughes et al. . | |
| 3,719,966 | 3/1973 | Lamont . | |
| 3,797,065 | 3/1974 | Hughes | 15/385 X |
| 3,813,726 | 6/1974 | Kowalewski . | |
| 4,000,538 | 1/1977 | Tissier . | |
| 4,363,152 | 12/1982 | Karpanty | 15/50.1 X |
| 4,441,229 | 4/1984 | Monson . | |
| 4,510,643 | 4/1985 | Kitada . | |
| 4,642,842 | 2/1987 | Hughes et al. . | |
| 5,163,203 | 11/1992 | Tanasescu et al. . | |
| 5,249,325 | 10/1993 | Wilen | 15/4 |
| 5,388,305 | 2/1995 | Fields | 15/385 |
| 5,428,863 | 7/1995 | Tanaseseu et al. . | |

FOREIGN PATENT DOCUMENTS

| | | |
|---|---|---|
| 1291642 | 3/1962 | France . |
| 1628859 | 7/1971 | Germany . |

*Primary Examiner*—Chris K. Moore
*Attorney, Agent, or Firm*—Peterson, Wicks, Nemer & Kamrath, P.A.

[57] ABSTRACT

A rotary disc floor apparatus (A) is disclosed for cleaning surfaces of floors or the like. The apparatus (A) includes a rotary block (30) having bristles (40) for scrubbing a floor surface with cleaning solution. The apparatus (A) further includes a wiper and vacuum nozzle assembly (20) having a ring (88) with squeegees (128) and nozzles (154) forming vacuum nozzle openings (163). The squeegees (128) and nozzles (154) include respective wiping portions (148, 166) having portions disposed outwardly of and located at a greater distance from the axis (B) than the nozzle openings (163). The squeegees (128) and nozzles (154) are readily removable and readily attachable to the ring (88) via shafts (140, 142, 158, 160). The apparatus (A) further includes flat springs (186) for biasing the ring (88) downward toward the floor surface and relative to the rotary block (30).

25 Claims, 4 Drawing Sheets

ROTARY DISC FLOOR CLEANING APPARATUS

BACKGROUND

The present invention relates generally to apparatus for cleaning floors, particularly to rotary disc floor apparatus, and specifically to rotary disc floor apparatus with scrubbers for scrubbing the floor and squeegees for wiping the floor.

Rotary disc cleaning apparatus are conventional in the art of cleaning floors. One mode of operation with this apparatus is to apply cleaning solution onto the floor, either by pouring the solution on the floor manually or by applying it to the floor through the use of a solution tank attached onto the apparatus itself. The floor is cleaned with the apparatus, and the remaining dirty solution is then removed from the floor through the use of a hand-held wand and squeegee attached to a tank vacuum.

Such a cleaning method is quite messy, as the cleaning solution setting on the floor may splash, run into corners, under objects and into areas immediately previously cleaned, or simply into unintended areas. This cleaning method may also be dangerous, as the solution setting on the floor may cause a relatively slippery floor, endangering passersby or the operator himself. To reduce the chance of injury, the area to be cleaned may be cordoned off and then cleaned. The cordoning and cleaning operation then is moved to the next area and so on. Since area after area is closed to traffic and hence undesirable during business hours, cleaning is usually restricted to after-hours. However, emergency clean-up operations are fairly common, and at such times pedestrian traffic is usually diverted at the customer's inconvenience so that the dirty area may be cleaned.

Another major disadvantage to this type of cleaning is that it is labor intensive and inefficient. As the solution on the floor becomes dirty, it is increasingly difficult for the operator to determine if the floor has been adequately cleaned because the dirty solution impedes the view of the floor. Time may be wasted when the operator makes multiple passes over an area, when in fact one pass might clean adequately. Or the operator might think the area is adequately cleaned, and after the dirty solution is drawn up with the vacuum, the operator may discover that the area is still dirty. So the entire cleaning process is repeated. This type of cleaning also disadvantageously requires the purchase and maintenance of two pieces of cleaning equipment: a rotary disc cleaning apparatus and a tank vacuum.

The prior art shows a great number of rotary floor cleaning apparatus having a wide variety of features. For example, U.S. Pat. No. 3,624,668 discloses elongated, radially extending suction pickup nozzles, each of which has a radially extending blade mounted therein which acts as a squeegee and further discloses stabilizing fins circumferentially spaced intermediate the pickup nozzles and acting as additional squeegees. Thus, it would appear that in U.S. Pat. No. 3,624,668, the blades help the pickup nozzles remove fluid from the floor whereas the stabilizing fins direct the fluid radially inwardly, with fluid being able to escape outwardly due to the circumferential spacing between the nozzles and the stabilizing fins. Whereas the pickup nozzles of U.S. Pat. No. 3,624,668 appear to be rigid and include separately formed blades, flexible vacuum pickups are also known. For example, U.S. Pat. No. 3,189,930 discloses tubular conduits formed of flexible plastic and which have flexible end portions which contact the surface of the floor covering. Further, U.S. Pat. No. 2,168,692 discloses a cleaning apparatus with nozzles which are surrounded by hard rubber sleeves having ends arranged flush with the surface of the brushes.

The prior art also shows other techniques of using squeegees to direct fluid to a vacuum nozzle and to prevent the escape of fluid outwardly from a rotating cleaning member. For example, U.S. Pat. No. 2,495,686 shows a special squeegee element which is composed of a circular perimetric portion extending completely and continuously around the perimeter of the head and an inwardly-directed liquid guiding portion of general spiral configuration and connected at its outer end to the perimetric portion, having its concave face extending in the direction of rotation and being disposed to extend in a spiral path completely around the axis of the head, and to terminate at said axis in adjacency to a suction tube arranged coaxially with the tube. However, since the squeegee element of U.S. Pat. No. 2,495,686 completely and continuously extends around the perimeter, entrance of fluid from outside of the perimeter is similarly prevented in the same manner as that fluid inside of the perimeter is prevented from exiting. Further, it can be appreciated that the squeegee element of U.S. Pat. No. 2,495,695 extends into the cleaning area of the brushes which detracts from its ability to maximize pressure engagement with the floor and which reduces the residence time of the fluid on the floor. Similarly, U.S. Pat. No. 4,000,538 shows a cleaning disc having its area circumscribed by a circular ring provided with two flexible skirts which form a flexible seal in contact with the ground and rotating with the cleaning disc. Likewise, U.S. Pat. No. 1,821,715 shows flexible tubes carried by the casing at the periphery and positioned interiorly of an outer peripheral rubber wall so that wetting of any other part of the floor other than that being cleaned does not occur.

Further, U.S. Pat. No. 2,893,037 discloses a floor scrubbing appliance with spirally extending slots spaced about the center of the brush and having sheet-like liners impervious to the passage of water, so that any water finding its way into a particular slot is prevented from passing the slot and will instead travel upwardly with the slot. Although entrance of fluid appears to be allowed from the outside, the appliance of U.S. Pat. No. 2,893,037 suffers from many of the same disadvantages as U.S. Pat. No. 2,495,645. Further, due to the elongated nature of the slots, air speed and thus fluid pickup through the slots appears to be limited in the appliance of U.S. Pat. No. 2,893,037.

In contrast to the prior art, the wiper portions of the present invention maximize the containment of fluid and minimize the escape of fluid while permitting fluid to flow easily from outside of the ring to its interior. Further, when fluid flows from the outside of the squeegee ring to the inside of the squeegee ring, there is no need for a change of direction of the fluid flow. Such is accomplished by using relatively short wipers or wiping portions less than the width of a hand, by using a great number of wipers or wiping portions about the circumference of the brush block, by overlapping the wipers or wiping portions so that there are no large gaps, by angling the wipers or wiper portions inwardly radially in the direction of rotation, and by using some integral wiper-nozzle assemblies, and by using such integral assemblies with front inlets.

SUMMARY

Accordingly, a general object of the invention is to provide a unique rotary disc floor apparatus for cleaning floors that cleans, vacuums, wipes, and dries floors thoroughly and efficiently.

Another object of the invention is to provide such a rotary disc floor apparatus having structurally unique nozzles. Specifically, the nozzle itself performs both functions of wiping the floor and drawing dirty cleaning fluid from the floor.

Another object of the invention is to provide such a rotary disc floor apparatus including a plurality of squeegees which uniquely are readily attachable and readily removable from the rotary disc. Specifically, a squeegee ring surrounds and is mounted on the rotary disc to provide means for ready attachment of the squeegees. The attachment means includes openings formed in the ring and shafts formed on the squeegees. The shafts have heads which snap into and out of the openings. The squeegees are attachable and removable from the ring independently of each of the other squeegees.

Another object of the invention is to provide such a rotary disc floor apparatus with unique means for mounting the squeegees to the rotary disc or block allowing axial, tippable movement. Such movement permits engagement of the squeegees with the floor when the bristles of the brush are relatively new, long and stiff to render the rotary disc at a high level relative to the squeegees, when the bristles of the brush are relatively old, worn, weak and short to render the rotary disc at a low level relative to the squeegees, when the squeegees are relatively new and stiff to render the squeegee ring at a high level relative to the rotary disc, and when the squeegees are relatively old and less resilient to render the squeegees at a low level relative to the rotary disc. The axial, tippable movement is uniquely permitted by radial lugs extending from the squeegee ring and slideable in axial slots formed in the brush block.

Another object of the invention is to provide such a rotary disc floor apparatus including vacuum tubes which uniquely contribute to urge the squeegee assembly downward toward the floor. Specifically, the vacuum tubes uniquely form generally the shape of an S or Z and extend to the squeegee ring to apply a downward pressure upon the squeegee ring.

Another object of the present invention is to uniquely maximize the retention of water within the squeegee ring, while uniquely permitting water to freely flow into the ring. Such an object is accomplished by the wiper portions mounted in a circle and which circumferentially overlap, yet having ends which are radially spaced from each other to permit water to flow into the circle.

Another object of the invention is to provide a unique squeegee assembly for removable attachment to a member having a hole. Specifically, the squeegee assembly includes a base portion having at least one stud for slideable receipt in the hole, an expandable head for holding the stud in the hole, and a wiper for wiping a surface. The head of the stud is resiliently compressible by hand to permit removal of the stud without the use of tools.

Another object of the present invention is to provide a unique nozzle for rotation about an axis. The nozzle includes a wiping portion and a nozzle portion having an inner panel portion with a bottom edge spaced above that of the wiping portion. The nozzle portion further includes a front wall with a bottom edge spaced above the inner panel portion to form an inlet, with the wiping portion extending beyond the front wall for directing fluid into the inlet.

Another object of the present invention is to provide a unique structure for communication between a vacuum generator and the pick-up nozzles. The structure includes a vacuum ring with a vacuum channel formed by outer and inner sidewalls and seals on upper and lower edges of the sidewalls, respectively. Tubes extend between the vacuum ring and the nozzles.

These and further objects and advantages of the present invention will become clearer in light of the following detailed description of an illustrative embodiment of this invention described in connection with the drawings.

BRIEF DESCRIPTION OF THE DRAWINGS

The illustrative embodiment may be best described by reference to the accompanying drawings where.

Figure 1:
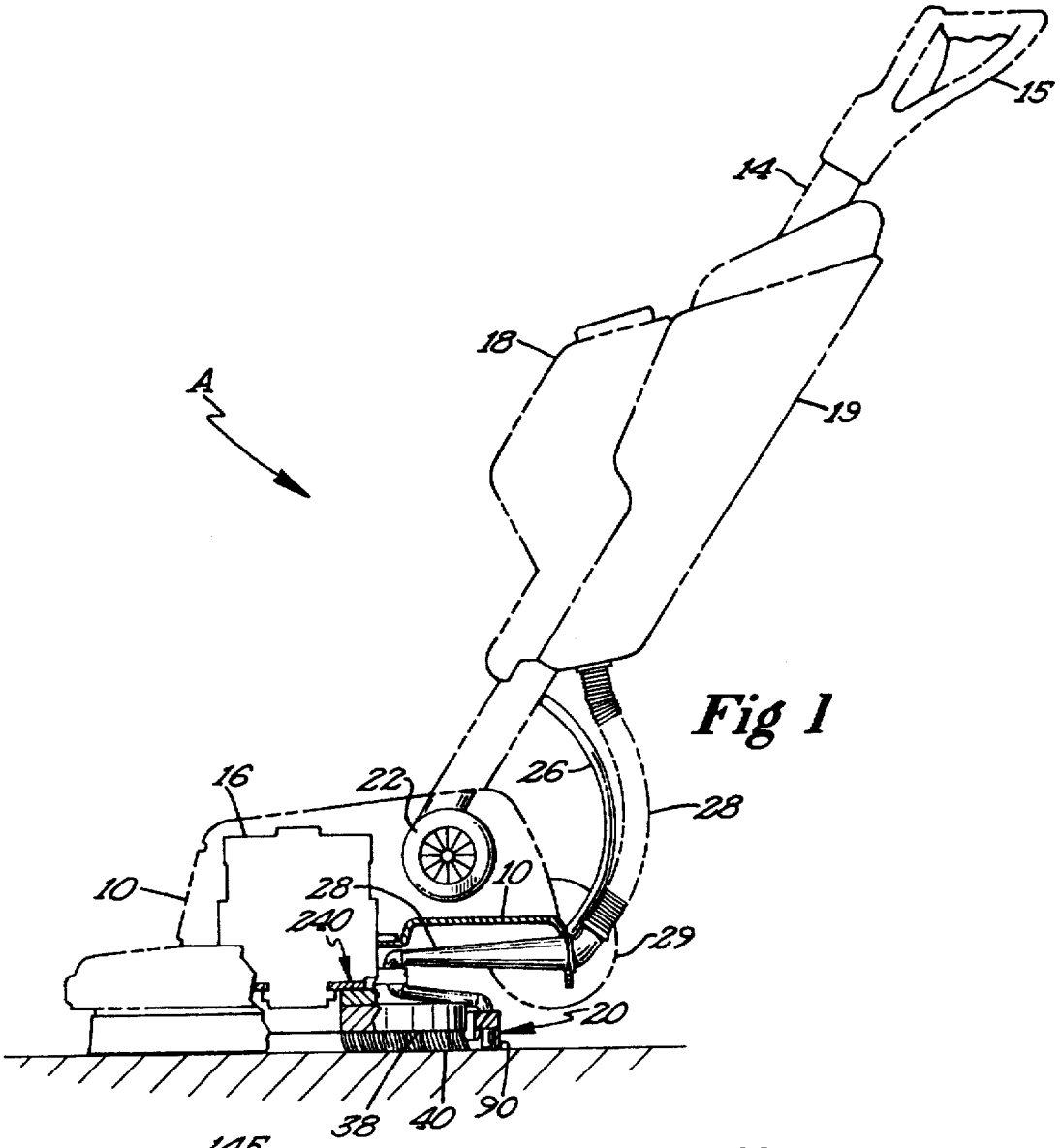
FIG. 1 shows a side elevation, partially phantom view of a preferred form of a rotary disc floor apparatus according to the preferred teachings of the present invention.
Figure 3:
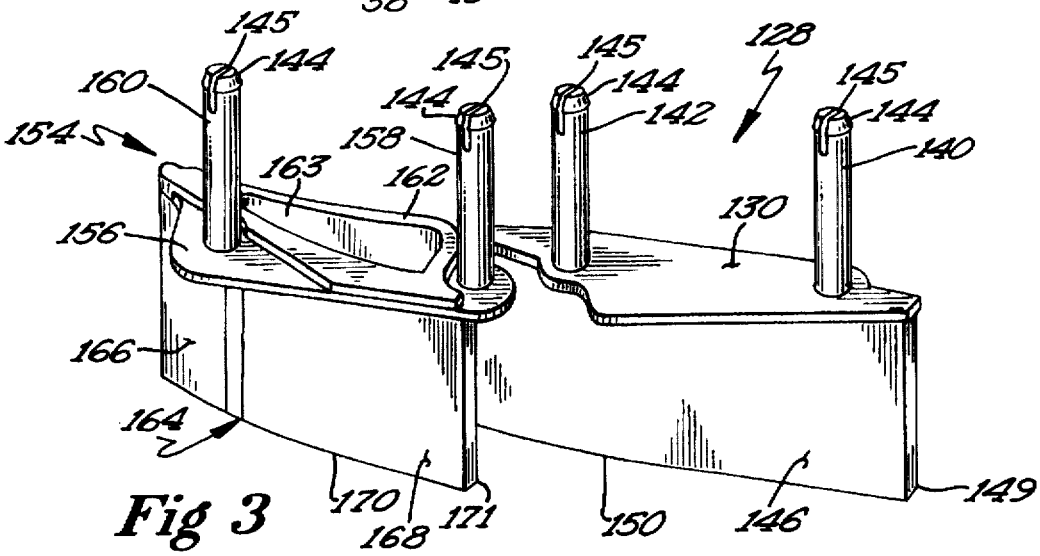
FIG. 3 shows a perspective view of a squeegee and a nozzle for the rotary disc floor apparatus of FIG. 1.
Figure 2:
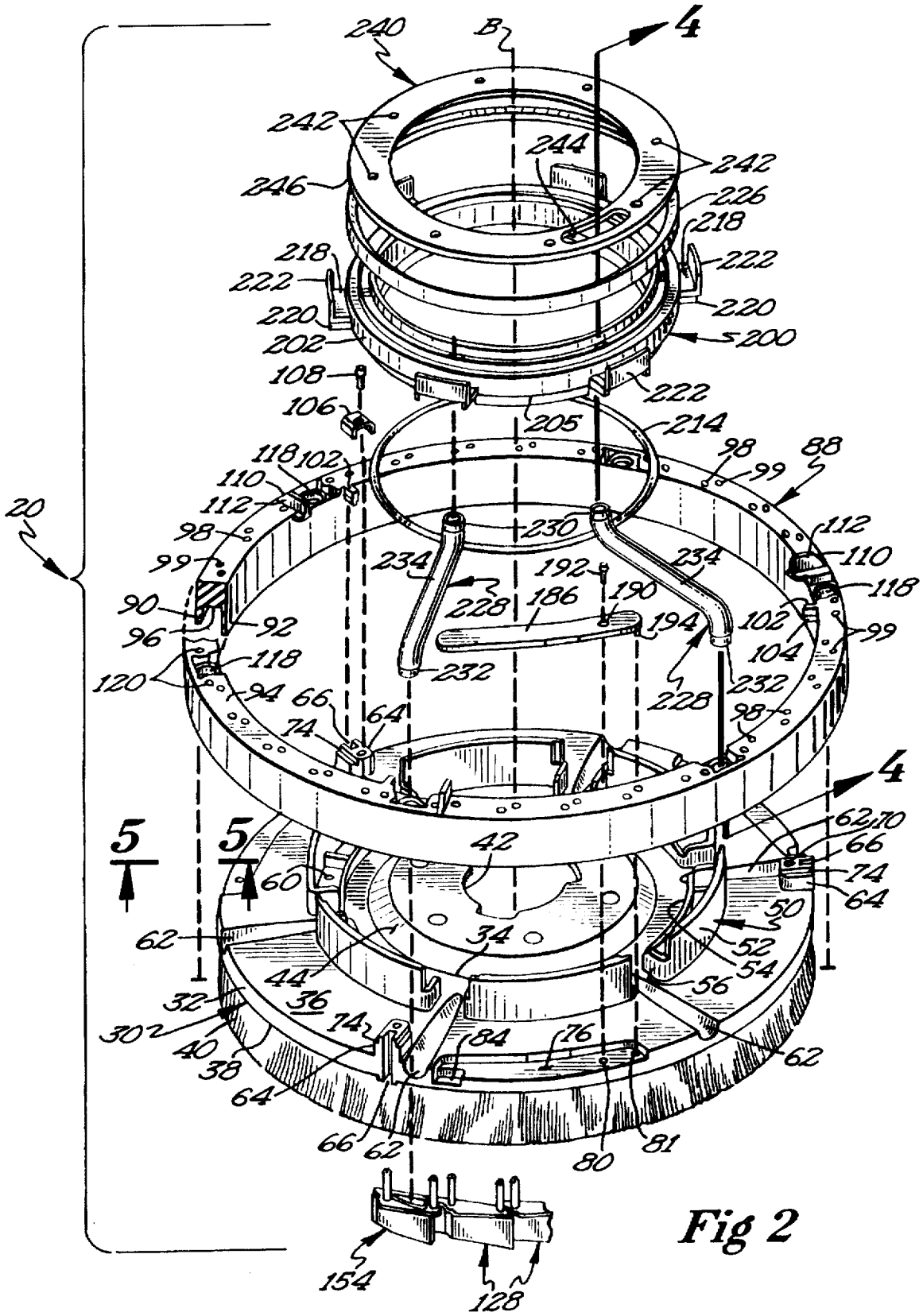
FIG. 2 shows an exploded, perspective view of the rotary disc and squeegee ring of the rotary disc floor apparatus of FIG. 1.
Figure 4:
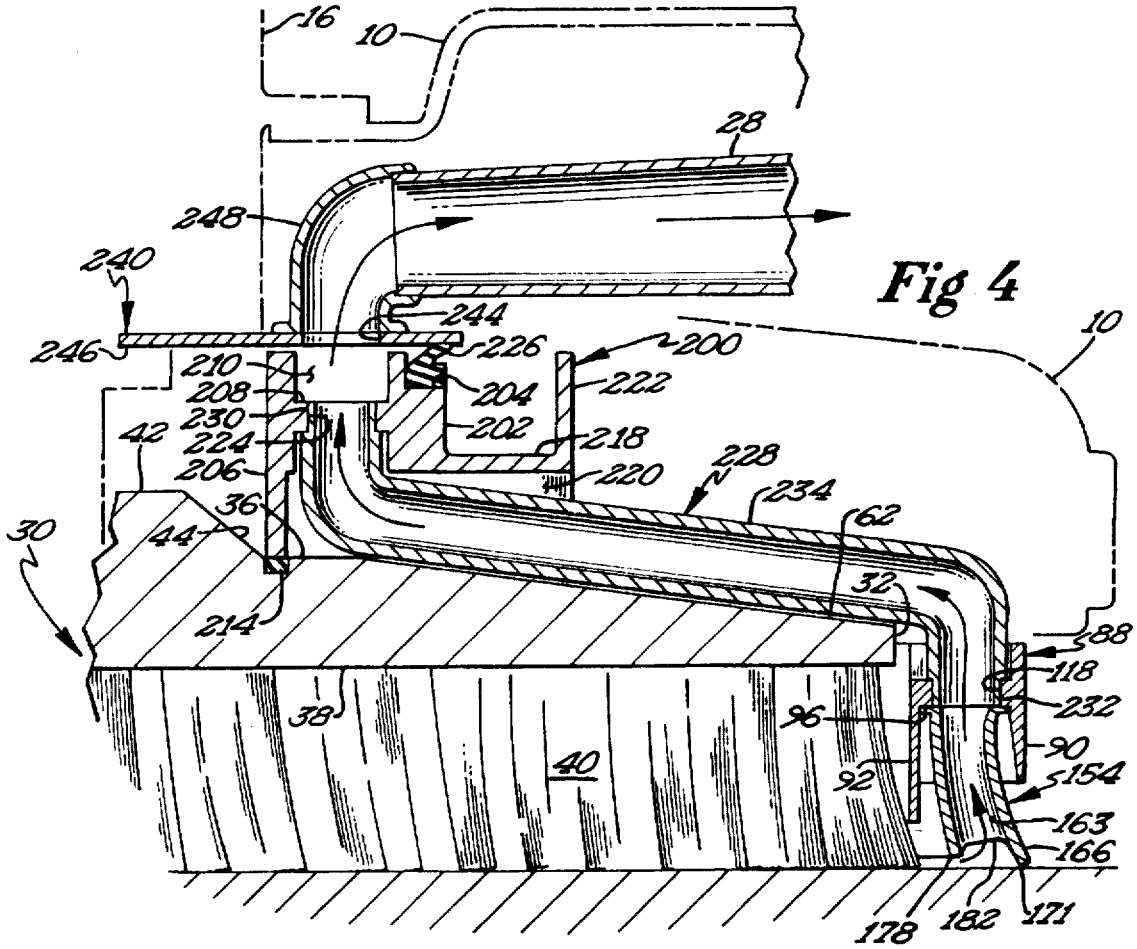
FIG. 4 shows a cross sectional view of the vacuum and squeegee ring of the rotary disc floor apparatus according to section lines 4—4 of FIG. 2.
Figure 5:
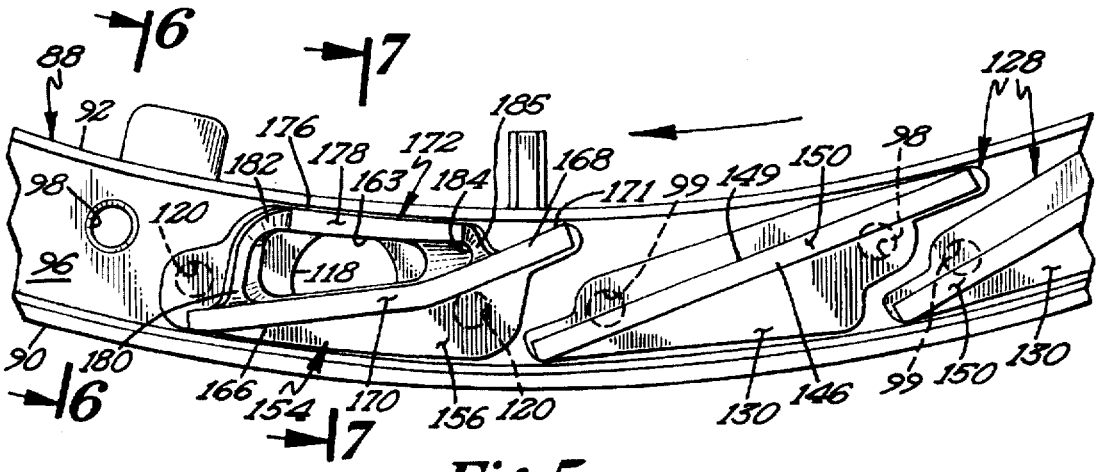
FIG. 5 shows a partial, bottom plan view of the rotary disc floor apparatus according to view lines 5—5 of FIG. 2.
Figure 6:
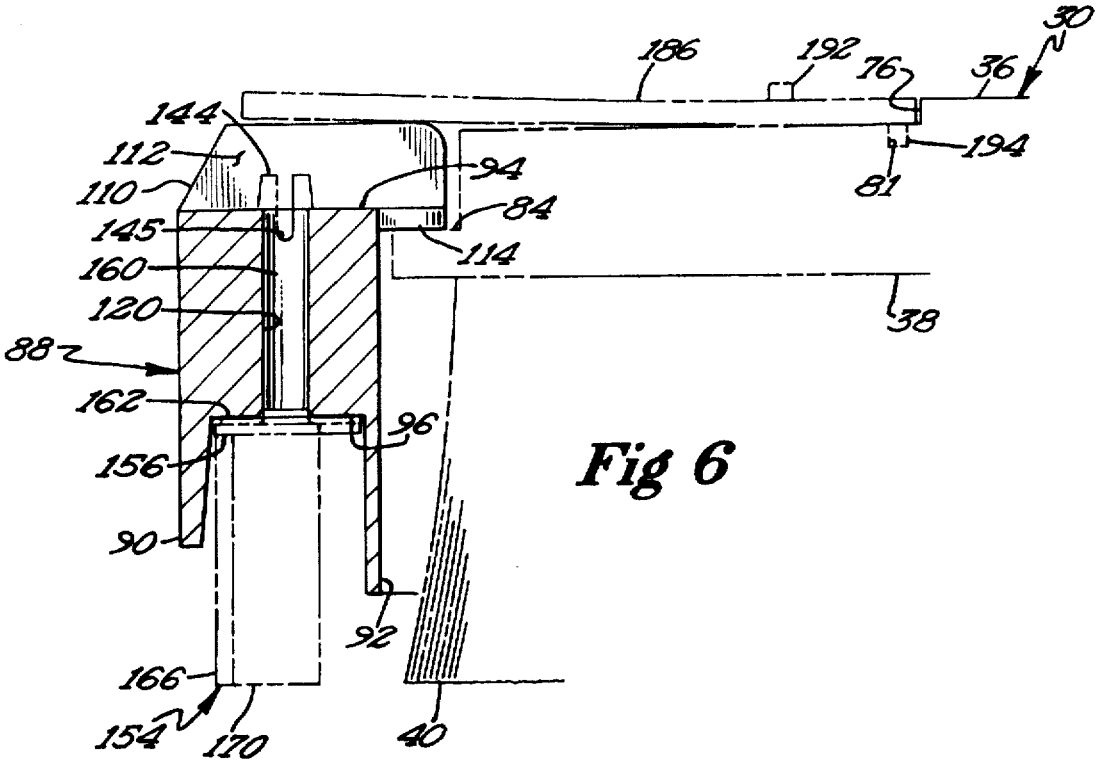
FIG. 6 shows a cross sectional view of the squeegee ring of the rotary disc floor apparatus according to section lines 6—6 of FIG. 5.
Figure 7:
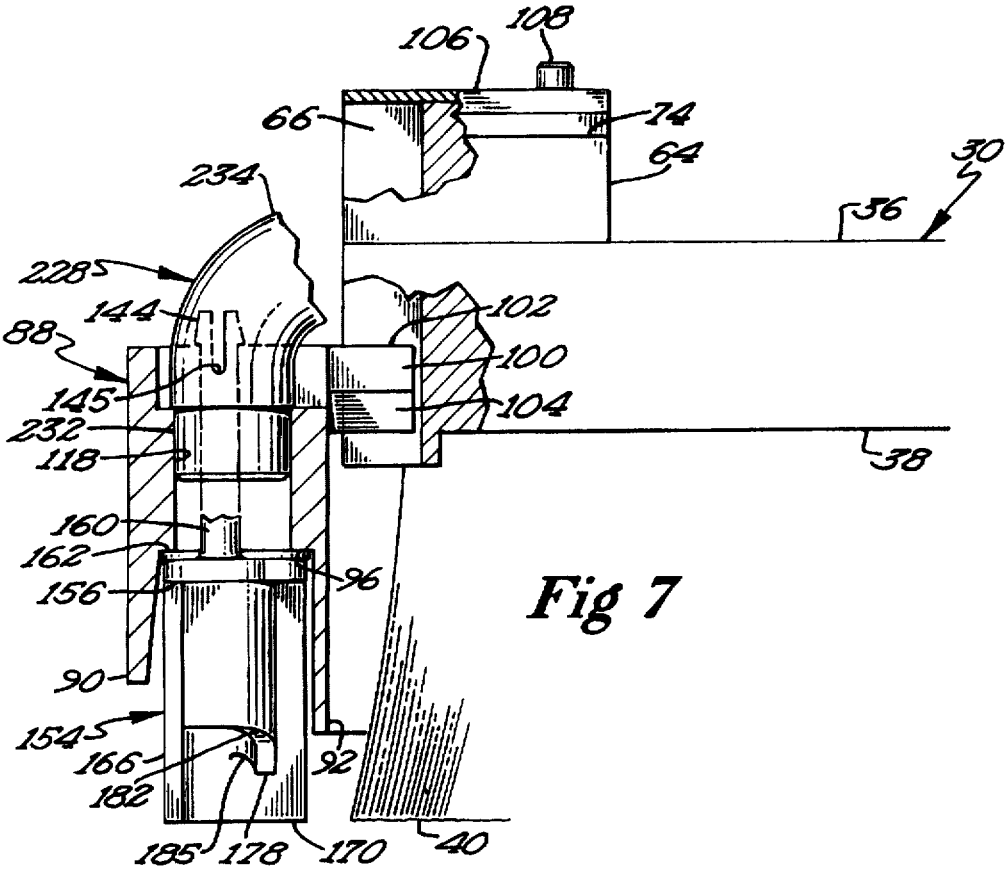
FIG. 7 shows a cross sectional, partially broken away view of the squeegee ring of the rotary disc floor apparatus according to section lines 7—7 of FIG. 5.

All Figures are drawn for ease of explanation of the basic teachings of the present invention only; the extensions of the Figures with respect to number, position, relationship, and dimensions of the parts to form the preferred embodiment will be explained or will be within the skill of the art after the following description has been read and understood. Further, the exact dimensions and dimensional proportions to conform to specific force, weight, strength, and similar requirements will likewise be within the skill of the art after the following description has been read and understood.

Where used in the various figures of the drawings, the same numerals designate the same or similar parts. Furthermore, when the terms "axial", "end", "peripheral", "radial", "inner", "inside", "inwardly", "outer", "outside", "lower", "higher" and similar terms are used herein, it should be understood that these terms have reference only to the structure shown in the drawings as it would appear to a person viewing the drawings and are utilized only to facilitate describing the preferred embodiment.

DESCRIPTION

Referring to the drawings in detail, a rotary disc floor machine or apparatus is shown according to the preferred teachings of the present invention and generally designated A. Rotary disc floor apparatus A includes a housing 10 pivotally attached to a handle post 14 having a hand grip 15. Within housing 10 is mounted a motor and gear box assembly 16. Apparatus A further includes a container 18 mounted on handle post 14 for holding cleaning solution, a container 19 mounted on handle post 14 for holding dirty solution, and a brush and vacuum nozzle assembly 20 for cleaning a floor and drawing dirty cleaning solution therefrom with the aid of a vacuum turbine motor 22 mounted in housing 10. A line 26 conveys fresh cleaning solution from container 18 for dispensing on the floor surface. A vacuum is applied to container 19 through a line running from vacuum turbine motor 22 to container 19 and further applied to brush and squeegee assembly 20 through a line 28. Apparatus A further includes transport wheels 29 for supporting apparatus A in a tilted position with brush and squeegee assembly 20 spaced from the floor, such as for moving apparatus A to the desired cleaning area.

Brush and squeegee assembly 20 includes a rotating pad or brush block 30 having an outer diametrical portion or side annular surface or outer peripheral edge 32, an inner diametrical portion 34, an upper surface 36, and a lower surface 38. Attached to lower surface 38 are bristles 40 extending from outer diametrical portion 32 to inner diametrical portion 34.

Brush block 30 further includes a clutch plate 42 for removable attachment to and for transmitting rotational torque from motor and gear box assembly 16 to brush block 30. Clutch plate 42 is attached to a beveled annular portion 44 which is rigidly affixed to inner diametrical portion 34 of brush block 30. Diametrical portions 32 and 34 and clutch plate 42 share a common axis of rotation B.

Brush block 30 further includes six upstanding, circumferentially spaced troughs 50 fixed on upper surface 36 for collecting the cleaning solution from container 18 and then directing the cleaning solution to bristles 40 on lower surface 32 of brush block 30. Each trough 50 includes an outer curved higher sidewall 52 and an inner curved lower sidewall 54, both of which are concentric to axis B. Sidewalls 52 and 54 are connected by radially extending end walls 56. Cleaning fluid flows from line 26 communicating with troughs 50 to bristles 40 through holes 60. Troughs 50 are spaced equidistance apart.

Brush block 30 further includes six vacuum tube receiving channels 62 circumferentially spaced equidistance apart and formed in upper surface 36 of block 30. Each channel 62 extends radially outward from between adjacent troughs 50 to open at outer diametrical portion 32, with channels 62 having increasing depth with increasing spacing from axis B. In the most preferred form, channels 62 have generally semicircular cross sections.

Three squeegee ring mounts 64 are formed integrally with block 30 at the outer diametrical portion 32 of block 30 and are circumferentially spaced equidistance apart. Each mount 64 extends from outer diametrical portion 32 radially inwardly and includes a vertical and axial slot 66 extending radially inwardly from outer diametrical portion 32 and parallel to axis B. Each slot 66 extends vertically through block 30 from slightly below lower surface 38 of block 30 to the upper surface of mount 64. The upper surface of mount 64 includes the threaded pin connector hole 70, with each of the radially extending sidewalls of mount 64 including a retainer supporting step or ridge 74.

Brush block 30 further includes three, flat spring receptors or depressions 76. Receptors 76 are circumferentially spaced equidistance apart about outer diametrical portion 32 of block 30. Each receptor 76 runs circumferentially about outer diametrical portion 32 and opens upwardly toward top surface 36 and outer diametrical portion 32 of block 30. Each receptor 76 includes a threaded pin connector hole 80 and a pin locator hole 81 circumferentially spaced from hole 80 adjacent its first end. A box shaped pocket 84 having a bottom floor or stop is provided adjacent the second end of receptor 76. Pocket 84 opens upwardly toward top surface 36 and outer diametrical portion 32 of block 30.

Brush and squeegee assembly 20 further includes the squeegee ring or member 88 including the downward extending outer sidewall 90 and the downward extending inner sidewall 92 of greater axial length than outer sidewall 90. The diameter of inner sidewall 92 and of ring 88 is slightly greater than that of outer diametrical portion 32. Squeegee ring 88 further includes an annular portion interconnecting sidewalls 90 and 92 and having an upper surface 94 and a lower surface 96 extending between sidewalls 90 and 92.

Squeegee ring 88 further includes a plurality of inner and outer stud receiving holes 98 and 99 running vertically from upper surface 94 to lower surface 96. Each inner stud receiving holes 98 is formed adjacent inner sidewall 92 and is paired with one of outer holes 99 formed adjacent outer sidewall 90. Thus, the paired holes 98 and 99 are offset from each other in the radial direction.

Squeegee ring 88 further includes three integral lugs 100 extending radially inwardly from inner sidewall 92 of ring 88 for reception into slots 66 of brush block 30. Each lug 100 includes upper end or stop 102 flush with upper surface 94 of ring 88 and the tapered, lowered end 104 for ready reception into slot 66. The slideable receipt of lugs 100 in slots 66 rotatably relate ring 88 to brush block 30 to transmit the rotational torque from brush block 30 to squeegee ring 88 while permitting vertical or axial travel of squeegee ring 88 relative to brush block 30 and in a direction parallel to axis B. The slideable receipt of lugs 100 in slots 66 further permit ring 88 to be tippable relative to brush block 30.

Generally U-shaped retainers 106 close slot 66 at the upper surface of mount 64 to provide an upper movement vertical or axial limit to ring 88 relative to brush block 30. In the preferred form, retainers 106 are fixed to mounts 64 via threaded pin connectors 108 engaged in holes 70 with the lower ends of the legs of retainers 106 abutting with ridges 74 of mounts 64.

Squeegee ring 88 further includes three integral tabs 110 extending radially inward from ring 88 and circumferentially spaced equidistance apart. Each tab 110 includes two integral upper and lower extensions 112 and 114 disposed at right angles to each other. Upper extension 112 extends radially in a vertical plane from upper surface 94 of squeegee ring 88 and includes an upper surface or stop. Lower extension 114 extends in a horizontal plane inwardly from inner sidewall 92 of ring 88. The lower surface of extension 114 engages the floor of pocket 84 for providing a downward movement limit to ring 88.

Squeegee ring 88 further includes six vacuum tube receptors or holes 118, with each receptor 118 having a set of two stud receiving holes 120 formed in ring 88 on opposite sides of receptors 118. Each receptor 118 extends upwardly from lower surface 96 of ring 88 to upper surface 94 intermediate sidewalls 90 and 92 of ring 88.

Assembly 20 further includes a plurality of snap-on squeegees or wiper blades 128 mounted to ring 88 between sidewalls 90 and 92 and generally concentric to axis B. Each snap-on wiper blade 128 includes rigid base portion 130, the upper surface of which abuts against lower surface 96 of ring 88. Integrally extending upwardly from base portion 130 are front and rear studs 140 and 142 for slideable receipt in holes 99 and 98, respectively, with the length of studs 140 and 142 being generally equal to the length of holes 98 and 99 between surfaces 94 and 96. Each stud 140 and 142 includes a barbed head or tip 144 which lies above and engages upper surface 94. Tip 144 includes a slot 145 for permitting tip 144 to be pinched or compressed for ready disengagement of wiper blade 128 from squeegee ring 88. When not compressed or pinched, tips 144 are resiliently expandable beyond the diameter of holes 98 and 99 to abut with surface 94 such that studs 140 and 142 are held in holes 99 and 98. It should be noted that tip 144 in its uncompressed condition is of an enlarged diameter as to the remaining portion of its respective stud 140 and 142. Tip 144 is beveled annularly from its free end for ready reception in holes 98 and 99. Two studs 140 and 142 are provided to keep base portion 130 from rotating relative to ring 88.

Snap-on wiper blades 128 each further includes a generally linear wiper portion 146 formed of generally flexible material extending downward from base portion 130 and terminating in a flat lower edge 152. The corner edge 149 of wiper portion 146 for wiping the floor is formed by bottom flat edge 152 and the radially inner wall surface of wiper portion 146. Wiper portion 146 is angled inwardly radially in the direction of rotation and lies at a small angle to a tangent of ring 88.

Squeegee ring 88 further includes snap-on wiper nozzles 154 mounted to ring 88 between sidewalls 90 and 92 and generally concentric to axis B.

Each wiper nozzle 154 includes a base portion 156 formed of rigid material and having a radial width about equal to the distance between sidewalls 90 and 92 to limit radial movement of wiper nozzle 154. Extending integrally and upwardly from base portion 156 are front and rear studs 158 and 160 having the same barbed head 144 and slot 145 as studs 140 and 142. Studs 158 and 160 are slideably received in holes 120. An opening 163 is formed in base portion 156 including an annular nipple extending downwardly therefrom. Each wiper nozzle 154 includes a wiper blade portion 164 formed of flexible material and extending downward from base portion 156 to the floor and terminates in flat bottom edge 170. Wiper blade portion 164 extends from outer ring sidewall 90 to inner ring sidewall 92. Wiper blade portion 146 is angled inwardly radially in the direction of rotation and extends at a small angle to a tangent of the circle. Wiper blade portion 164 includes a front panel portion 166 and a rear panel portion 168 disposed generally linearly, though somewhat obliquely relative to the front panel portion 166. Rear panel portion 168 is disposed radially and circumferentially inwardly of the immediately rearwardly adjacent wiper blade 128. Front panel portion 166 is disposed radially and circumferentially outwardly of the immediately preceding adjacent wiper blade 128. The corner edge 171 for wiping a floor is formed by bottom flat edge 170 and the inner wall surfaces of the panel portions 166 and 168.

Each wiper nozzle 154 further includes a generally C-shaped nozzle portion 172 extending downward from base portion 156 and integral with wiper blade portion 164. Nozzle portion 172 includes an inner panel portion 176 which terminates in flat bottom edge 178 forming a corner edge. In the most preferred form, inner panel portion 176 is concentric to axis B. When apparatus A is at rest, edge 178 is disposed above wiping edge 171. When apparatus A is in operation, generally both edges 171 and 178 engage the floor, with edge 178 preferably riding off the floor slightly. Panel portion 176 has a circumferential length which is substantial in relation to wiper blade portion 164 and is disposed adjacent to sidewall 92. Nozzle portion 172 further includes a front panel 180 integrally extending between the front of portion 176 and panel portion 166 behind the leading edge thereof. Panel 180 terminates in inlet forming edge 182 which is spaced above edges 170 and 178. Nozzle portion 172 further includes a rear panel 184 integrally extending between the rear of portion 176 and panel portion 168 ahead of the trailing edge thereof. Panel 184 terminates in rear inlet forming edge 185 which is spaced above edges 170 and 178 but below edge 182. When apparatus A is at rest and in operation, edges 182 and 185 are above edges 171 and 178 and when apparatus A is in operation, vacuum orifices or inlets are formed by edges 178, 182 and 185 and the floor.

In the most preferred form, portions 164 and 172 are integrally formed and molded upon base portion 156, with portions 164 and 172 extending on both sides of the nipple extending from opening 163 and extending vertically downward from the nipple. Portions 164 and 172 extending on the inside of the nipple integrally terminate in a seal 162 located on the upper surface of base portion 156 and sandwiched between base portion 156 and surface 96. It can then be appreciated that seal 162 seals opening 163 with receptor 118.

Both base portion 156 of nozzle 154 and base portion 130 of squeegee 128 are relatively stiff and formed from a rigid polymer. Portions 164 and 172 are relatively resilient and formed from 40 shore A durometer urethane. Wiper portions 146 are relatively resilient and formed from 50 shore A durometer.

Brush and squeegee assembly 20 further includes three flat springs or cantilever spring arms 186 for biasing squeegee ring 88 vertically downward relative to brush block 30. Each spring arm 186 has a fixed end including a pin connector hole 190 for engagement with a pin connector 192 which is threaded into hole 80. The fixed end further includes an integral pin 194 for receipt within pin locator hole 81 to prevent pivotable movement about pin connector 192. Each spring arm 186 further includes a cantilever end opposite the fixed end and extending over the upper surface of extension 112. The cantilever end places downward pressure on tabs 110 while permitting tab extension 114 to ride vertically up and down in pocket 84.

Brush and squeegee assembly 20 further includes a vacuum ring 200 which is rigidly fixed, such as with pin connectors, to brush block 30. Ring 200 includes an annular outer sidewall 202, an annular inner sidewall 206, and an annular interconnecting portion 208 integrally joining the sidewalls 202 and 206, with sidewalls 202 and 206 being concentric to axis B and interconnecting portion 208 extending radially from axis B. A vacuum channel 210 is formed by sidewalls 202 and 206 above portion 208. Sidewall 202 includes an upper annular shoulder 204 and a lower annular shoulder 205. Shoulder 205 slideably receives sidewalls 54 of troughs 50. The lower end of inner sidewall 206 engages brush block 30. An O-ring 214 is received in an annular groove formed in brush block 30 adjacent annular portion 44 and sealingly engages the lower end of sidewall 206. Vacuum ring 200 further includes six equally circumferentially spaced plate portions 218 extending radially outward from sidewall 202. Each plate portion 218 has first and second, parallel flanges 220 extending downward therefrom for engaging the upper edges of end walls 56. Extending upwardly from the outer end of each plate portion 218 is a curved plate portion 222 for extending between the upright edges of outer walls 52 of adjacent troughs 50. The ends of walls 52 can include suitable shoulders for slideable receipt of plate portion 222. The upper edges of outer walls 52 and plate portions 222 are flush. Curved plate portions 222 share axis B with outer trough sidewalls 52. Vacuum ring 200 further includes six vacuum tube receptors or holes 224 formed in annular interconnecting portion 208 and radially aligned with portions 218 and 222. Vacuum ring 200 further includes an annular seal such as a V-ring 226 located on shoulder 204.

Brush and squeegee assembly 20 further includes six vacuum tubes 228 extending between vacuum ring 200 and squeegee ring 88. Each vacuum tube 228 is generally Z-shaped and includes an upper end 230, a lower end 232, and a middle linear portion 234. Ends 230 and 232 extend obliquely from middle linear portion 234. Ends 230 are inserted into vacuum ring holes 224 and ends 232 are inserted into the corresponding squeegee ring holes 118 with a suitable sealing relation. Such a sealing relation can be accomplished such as shown in the Figures or by other provisions such as but not limited to integral nipples extending within bores with tubes 228 slideably received in the nipples and held thereon by O-rings sandwiched between the inside surface of the bore and the outside surface of the portion of tube 228 slid on the nipple. Linear portions 234 are aligned with channel 62 and are at least slightly spaced from the bottom surface of channels 62 as the resiliency of tubes 228 exerts a downward force on squeegee ring 88 as well as permitting axial movement of ring 88 relative to brush block 30.

Vacuum ring 200 rotationally engages motor and gear box assembly 16 at a stationary stainless steel ring 240. Ring 240 is flat and includes the eight pin connector holes 242 for receiving pin connectors which engage assembly 16 and/or housing 10. Ring 240 further includes an elongated slot 244 extending between two of the pin connector holes 242 for communication with vacuum channel 210. Ring 240 further includes a lower surface 246 which is spaced from the upper annular edges of the sidewalls 202 and 206 but sealingly engages with seal 226.

Line 28 includes an inlet 248 affixed to ring 240 in communication with slot 244.

It should be noted that O-ring 214 and seal 226 create vacuum seals on either end of vacuum ring 200. O-ring 214 creates a vacuum seal relative to brush block 30 and seal 226 creates a vacuum seal relative to the stainless steel ring 240. Generally, assembly 16 and/or housing 10 provides an air tight abutment with clutch plate 42 to prevent air passage therebetween. As sidewall 206 is not sealed with ring 240, theoretically communication is allowed by the spacing therebetween to the interior space or volume defined by sidewall 206, assembly 16, housing 10, clutch plate 42, block 30, and ring 214. However, as air entry to the interior space is prevented, vacuum applied by line 28 will be applied by channel 210 to tubes 228. A major advantage of the arrangement is the use of a seal such as O-ring 214 between two parts which do not relatively rotate and thus are less expensive and not susceptible to wear.

Now that the construction of rotary disc floor apparatus A according to the teachings of the preferred embodiment of the present invention has been explained, the operation, subtle features and advantages of the preferred construction of the present invention can be set forth. In general operation, vacuum is created by vacuum turbine motor 22 and applied to vacuum ring 200 via opening 244 in stainless steel ring 240. The vacuum is created and contained within vacuum channel 210 and further created in vacuum tubes 228, which in turn open into vacuum nozzles 154. As brush block 30 rotates, springs 186 apply a downward force to squeegee ring 88 to force squeegees 128 and nozzles 154 into position for optimum wiping. The cleaning solution is fed down through brush block 30, contacts the floor and is worked against the floor by the rotating bristles 40. As apparatus A is moved across the floor, the solution at the outer periphery of brush block 30 contacts squeegees 128 and nozzles 154. Squeegees 128 and nozzles 154 contain the dirty solution and wipe the floor dry. Nozzles 154 create vacuum inlets on the floor having relatively small cross sections thus maximizing the velocity of the vacuum air at the vacuum inlets which lifts the dirty solution from the floor surface. The dirty solution is carried through vacuum tubes 228, into vacuum channel 210, and through opening 244 in stainless steel ring 240. It then proceeds through flexible line 28 to dirty solution retaining container 19 where it is contained for disposal.

More particularly, it can be appreciated that, as brush block 30 and squeegee ring 88 are rotated, the squeegees 128 and nozzles 154 are resiliently bent radially outwardly by such rotation and by the downward force being applied by flat springs 186 and vacuum tubes 228. Further as squeegees 128 and nozzles 154 bend, corner edges 149 and 171 wipe and dry the floor as flat bottom edges 152 and 170 are disposed obliquely relative to the floor.

Sidewall 90 of squeegee ring 88 acts as protection for the upper portions of squeegees 128 and nozzles 154 to prevent damage which may be caused by squeegee ring 88 coming into contact with objects such as stationary store racks. Inner sidewall 92 of squeegee ring 88 may be positioned about 0.25 inches (0.635 cm) above the floor and serves as a splash guard to direct solution into close proximity with the floor where squeegees 128 and nozzles 154 control and contain the solution.

The circumferential overlapping relationship of squeegees 128 and nozzles 154 further contribute to containing the cleaning solution radially inwardly according to the teachings of the present invention. Such an overlapping relationship is provided in part by the leading edges of squeegees 128 circumferentially overlapping and spaced radially outwardly of the trailing edges of adjacent squeegees 128 or the trailing edges of adjacent nozzles 154. Such a relationship is further provided by leading portions 166 of nozzles 154 circumferentially overlapping and spaced radially outwardly of the trailing edge of an adjacent squeegee 128. Accordingly, wiping corner edges 149 and 171 form an essentially continuous barrier about the brush block 30 to reduce the possibility of outward splash due to the centrifugal force generated by rotating bristles 40.

Even with the circumferential overlapping relationship, which keeps solution from splashing outwardly, the radial spacing of the leading edges from the trailing edges of squeegees 128 and nozzles 154 according to the preferred teachings of the present invention also permits solution to flow into the interior of ring 88. Specifically, the radial spaced, yet circumferential overlapping, relationship of squeegees 128 among themselves and with nozzles 154 let solution into ring 88 where it may be mixed with cleaning solution by bristles 40 and ultimately picked up by nozzles 154.

In addition to the advantages set forth previously, the relationship of squeegees 128 and nozzles 154 arranged on ring 88 in a circle around the cleaning member shown in the most preferred form as bristles 40 is further advantageous. Specifically, the cleaning member may have a tendency to carry any wiping members extending therein to prevent their engagement with the floor at their optimum wiping pressures such that a thin film of solution could remain on the floor under the wiping members. Such a tendency would depend upon the materials from which the cleaning and wiping members are formed and the extent of their respective wear lives. Likewise, such wiping members would have a tendency to wipe solution away from the action of the cleaning member to the floor surface such that solution residence time with the cleaning member is minimized. It can then be appreciated that in assembly 20 according to the teachings of the present invention, the cleaning member in the preferred form of bristles 40 is inside the circle of ring 88 with squeegees 128 and nozzles 154 spaced therefrom such that squeegees 128 and nozzles 154 do not detract from the operation of bristles 40 and bristles 40 do not detract from the operation of squeegees 128 and nozzles 154. In particular, as wiping portions 146 and 164 are generally linear and extend at a small angle to the circle, they present wiping edges 149 and 171 in a nonparallel manner to the direction of rotation to better direct solution towards the center and bristles 40 and to prevent solution from inside of the circle from escaping while at the same time allowing solution from the outside of the circle from entering. Also, solution within the circle is allowed to remain on the floor surface until agitated on the floor by the bristles 40 and thrown by centrifugal forces to squeegees 128 and nozzles 154 and/or until apparatus A is moved on the floor to engage squeegees 128 and nozzles 154 with the solution. Also, spacing bristles 40 from squeegees 128 and nozzles 154 is advantageous in allowing their independent movement in directions parallel to the axis of rotation such as through the use of slots 66 and lugs 100 of the most preferred form.

Each nozzle 154 according to the teachings of the present invention acts as both a wiper and a vacuum orifice. Wiper blade panel portions 166 and 168 wipe the floor and at the same time seal the floor relative to the inlets such that air and dirty cleaning solution are drawn therethrough.

During rotation, solution tends to engage and/or be directed by the portion of panel portion 166 positioned ahead of front panel 180 into the inlet formed by edges 182 which is arranged generally perpendicular to the direction of travel. Solution not entering the inlet in front panel 180 would travel along the inner edge of panel portion 176 and would be subject to vacuum forces under edge 179. Any solution which travels along the full length of panel portion 176 has a tendency to be drawn in the inlet formed by edge 185 in rear panel 184. It can be appreciated that the narrow radial width of rear panel 184 in comparison to the radial width of front panel 180 and the lower spacing of edge 185 from the floor in comparison to the spacing of edge 182 increases the air speed at the rear inlet due to its relatively small size to maximize solution pickup and flow in the same direction as the rotation direction of nozzle 154.

It can further be appreciated that squeegees 128 and nozzles 154 are readily removable by hand without tools and readily attachable by hand without tools from squeegee ring 88. Each of the squeegees 128 and nozzles 154 includes shafts 140, 142, 158, and 160 with heads 144 which are resiliently expandable beyond the diameter of holes 98, 99, and 120 such that shafts 140, 142, 158, and 160 are snappable to ring 88. Heads 144 are further resiliently compressible by hand to less than or equal to the diameter of holes 98, 99, and 120 to permit heads 144 to be slid out of holes 98, 99, and 120 without the use of tools. It can be appreciated that each of the squeegees 128 and nozzles 154 are attachable to and removable from ring 88 independently of each of the other squeegees 128 and nozzles 154.

In the most preferred form of the invention, squeegees 128 are reversible when worn to permit both edges to be used for wiping. It can be appreciated that base portion 130 must be configured to be in a non-abutting relation with each other or nozzles 154 when mounted to ring 88 in a reversed position. Wiper portion 146 preferably lies in a single plane when intended to be reversible. However, it should be noted that wiper portion 146 may have a bend. Such a bend provides a stronger wiper portion 146 and a harder wipe to the floor. When wiper portion 146 includes a bend, squeegee 128 may not be reversible, yet is still removable.

Squeegee ring 88 is axially movable relative to brush block 30 by lugs 100 of squeegee ring 88 being slideably engaged in slots 66 of brush block 30 according to the preferred teachings of the present invention. Such axial movement is limited in the upward direction by retainers 106 on brush block 30 over slots 66 and in the downward direction by lower extensions 114 contacting the floor of pocket 84. Vertical or axial travel is advantageous as squeegees 128 and nozzles 154 are preferably positioned at a fairly constant vertical height so as to provide optimized wiping and vacuuming performance. Floor cleaning members such as brushes and pads wear thinner, so the vertical travel allows the pads and brushes to wear down, yet allows squeegees 128 and nozzles 154 to remain at their optimum height.

According to the preferred teachings of the present invention, flat springs 186 act as biasing means to urge squeegee ring 88 and squeegees 128 and nozzles 154 downward toward the floor relative to brush block 30. Vacuum tubes 228 of a Z-shape can contribute to the downward bias of squeegee ring 88 and are resilient to permit vertical travel of squeegee ring 88. Accordingly, squeegee ring 88 engages the floor when bristles 40 or like cleaning members are worn or new and/or when squeegees 128 and nozzles 154 are worn or new. The spring force of flat springs 186 is pre-set so that squeegees 128 and nozzles 154 are forced into their optimum wiping positions.

It can be further appreciated that brush and vacuum nozzle assembly 20 according to the teachings of the present invention may be utilized on other types of apparatus A than shown such as a self-propelled vehicle such as an electrically driven cart or tractor with a seat or a straight line, manually pushed machine.

It can further be appreciated that a different number of nozzles 154 may be used instead of six. With fewer nozzles 154 such as three, for a given amount of vacuum generated by vacuum turbine motor 22, fluid being drawn through nozzles 154 has a greater velocity and hence a greater vacuum or pick up capacity is generated adjacent the floor. A drier floor is the result.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalents of the claims are intended to be embraced therein.

We claim:

1. Assembly for rotation by a surface cleaning machine about an axis in a direction comprising, in combination: a block connectable to the surface cleaning machine for rotation about the axis, with the block including an outer peripheral edge, a lower surface, and an upper surface; first means rotatable with the lower surface of the block for cleaning the surface to be cleaned; a ring having a shape and size larger than the outer peripheral edge of the block, with the ring having at least a first hole; a plurality of axial slots formed in one of the block and the ring and extending parallel to the axis; a plurality of lugs extending radially from the other of the block and the ring and slideable in the axial slots for mounting the ring to the block for rotation about the axis therewith and allowing movement of the ring relative to the block in the direction parallel to the axis; a plurality of individual, generally linear wipers removably attached to the ring in a circle concentric to the axis, with each wiper having a wiping portion including a bottom edge, a leading edge and a trailing edge located circumferentially behind the leading edge in the direction of rotation, with each of the leading edges being located at a greater distance from the axis than each of the trailing edges, with each of the leading edges circumferentially overlapping the trailing edge of another wiper to minimize the escape of dirty cleaning solution between the individual wipers and radially outwardly of the leading edges of the wipers, with each of the wipers extending at a small angle to a tangent of the circle, with the first means for cleaning the surface to be cleaned being inside of the circle of the ring, with each of the wipers being generally spaced from the first cleaning means in a manner wherein the wipers do not detract from the operation of the first cleaning means and the first cleaning means does not detract from the operation of the wipers; with each wiper comprising, in combination: a base portion having an upper surface and a lower surface, with the upper surface of the base portion abutting with the ring and further having at least a first stud for slideable receipt in the hole, with the first stud extending from the upper surface of the base portion, and means integrally formed with the stud for removably holding the stud in the hole, with the stud being removable from the hole without the use of tools, with the wiping portion being integrally secured to the lower surface of the base portion, with at least some of the plurality of wipers further including a nozzle portion integrally connected to the wiping portion, with each nozzle portion including an inner panel having a bottom edge spaced above the bottom edge of the wiping portion, and a front panel extending between the inner panel and the wiping portion, with the front panel having a bottom edge spaced above the bottom edge of the inner panel to form a first inlet between the wiping portion and the inner panel; a vacuum ring secured to the upper surface of the block for rotation therewith and having an inner sidewall concentric to the axis, an outer sidewall concentric to the axis at a greater distance from the axis than the inner sidewall, and an annular interconnecting portion extending radially from the axis and interconnecting the inner and outer sidewalls, with the inner and outer sidewalls and the annular interconnecting portion forming a channel therebetween, with the outer sidewall having an upper edge; means for sealing the channel relative to the surface cleaning machine, with the sealing means including a first seal mounted on one of the upper edge of the outer sidewall and the surface cleaning machine and rotatably abutting with the other of the upper edge of the outer sidewall and the surface cleaning machine; at least a first opening formed in the interconnecting portion; and at least a first tube extending between the first opening in the vacuum ring and one of the nozzle portions for conveyance of the solution from the nozzle portion to the surface cleaning machine.

2. Assembly for rotation by a surface cleaning machine about an axis comprising, in combination: a block connectable to the surface cleaning machine for rotation about the axis, with the block including an outer peripheral edge and a lower surface; means rotatable with the lower surface of the block for cleaning the surface to be cleaned; a ring having a shape and size larger than the outer peripheral edge of the block, with the ring including means for cleaning the surface to be cleaned; a plurality of axial slots formed in one of the block and the ring and extending parallel to the axis; and a plurality of lugs extending radially from the other of the block and the ring and slideable in the axial slots for mounting the ring to the block for rotation about the axis therewith and allowing movement of the ring relative to the block in the direction parallel to the axis.

3. The assembly of claim 2 wherein the cleaning means on the ring comprises a plurality of squeegees arranged concentrically around the axis.

4. The assembly of claim 2 further comprising, in combination: means for biasing the ring downwardly relative to the block.

5. The assembly of claim 4 wherein the biasing means comprises a flat spring having two ends, one of the ends being fixed to one of the block and the ring and the other end being engaged to the other of the block and the ring such that the ring is biased downward toward the surface to be cleaned relative to the block.

6. The assembly of claim 2 further comprising, in combination: means between the block and the ring for restricting movement of the lugs in the slots parallel to the axis.

7. The assembly of claim 6 wherein the restricting means comprises retainers at least partially closing the slots to prevent the lugs from sliding out of the slots for providing one of an upward and downward movement limit for the ring.

8. The assembly of claim 6 wherein the restricting means comprises, in combination: tabs on one of the block and the ring; and stops on the other of the block and the ring, with the tabs abutting the stops for providing one of an upward and downward movement limit for the ring.

9. Assembly for rotation in a direction by a surface cleaning machine about an axis comprising, in combination: a member for rotation about the axis; a plurality of individual, generally linear wipers arranged on the member in a circle concentric to the axis, with each wiper including a leading edge and a trailing edge located circumferentially behind the leading edge in the direction of rotation, with each of the leading edges being located at a greater distance from the axis than each of the trailing edges, with each of the leading edges circumferentially overlapping the trailing edge of another wiper to minimize the escape of dirty cleaning solution between the individual wipers and radially outwardly of the leading edges of the wipers, with each of the wipers extending at a small angle to a tangent of the circle; and means for cleaning the surface to be cleaned rotatable about the axis and inside of the circle of the member, with each of the wipers being generally spaced from the cleaning means in a manner wherein the wipers do not detract from the operation of the cleaning means and the cleaning means does not detract from the operation of the wipers.

10. The assembly of claim 9 wherein the leading edge is radially spaced from the trailing edge of an immediately preceding wiper to allow introduction of solution located on the surface to be cleaned therebetween.

11. The assembly of claim 9 wherein only some of the plurality of wipers include a nozzle for picking up solution when vacuum is applied to the nozzle, with the remaining wipers being circumferentially intermediate the wipers including nozzles.

12. The assembly of claim 11 wherein the nozzle comprises in combination: a wiping portion having a bottom edge; and a nozzle portion integrally connected to the wiping portion and including an inner panel having a bottom edge spaced above the bottom edge of the wiping portion, and a front panel extending between the inner panel and the wiping portion, with the front panel having a bottom edge spaced above the bottom edge of the inner panel to form an inlet, with the wiping portion extending beyond the front panel for directing solution into the inlet.

13. Squeegee for removable attachment to a member having at least a first hole comprising, in combination: a base portion having an upper surface and a lower surface, with the upper surface abutting with the member and further having at least a first stud for slideable receipt in the hole, with the first stud extending from the upper surface of the base portion; means integrally formed with the stud for removably holding the stud in the hole, with the stud being removable from the hole without the use of tools; and a wiper portion having a bottom edge and integrally secured to the lower surface of the base portion.

14. The squeegee of claim 13 wherein the member includes first and second surfaces and the hole extends from the first surface to the second surface; and wherein the removably holding means comprises a head integrally secured to the stud, with the stud being of a length generally equal to the hole between the first and second surfaces such that the head extends beyond the first surface when the base portion abuts the second surface, with the head being resiliently expandable beyond the diameter of the hole to abut with the second surface such that the stud is held in the hole when the head extends beyond the second surface, and with the head of the stud being resiliently compressible to a size equal to or less than the hole to permit the head to slide through the hole.

15. The squeegee of claim 14 wherein the member has a second hole; and wherein the base portion further includes a second stud for slideable receipt in the second hole to keep the base portion from rotating relative the member about the first stud.

16. The squeegee of claim 13 further comprising, in combination: a nozzle portion integrally connected to the wiping portion and including an inner panel having a bottom edge spaced above the bottom edge of the wiping portion, and a front panel extending between the inner panel and the wiping portion, with the front panel having a bottom edge spaced above the bottom edge of the inner panel to form an inlet, with the wiping portion extending beyond the front panel for directing solution into the inlet.

17. Nozzle for rotation about an axis comprising, in combination: a wiping portion having a leading edge, a trailing edge, and a bottom edge, with the leading edge being circumferentially spaced ahead of the trailing edge when the nozzle is rotated about the axis and radially spaced from the axis at a distance greater than the trailing edge; and a nozzle portion integrally connected to the wiping portion and having an inner panel having a bottom edge spaced above the bottom edge of the wiping portion, and a front panel extending between the inner panel and the wiping portion, with the front panel having a bottom edge spaced above the bottom edge of the inner panel to form a first inlet between the wiping portion and the inner panel.

18. The nozzle of claim 17 wherein the wiping portion is circumferentially spaced ahead of the front panel when the nozzle is rotated about the axis for directing solution into the inlet.

19. The nozzle of claim 17 wherein the nozzle portion further includes a back panel having a bottom edge spaced above the bottom edge of the inner panel and having a length less than the front panel to form a second inlet between the wiping portion and the inner panel.

20. The nozzle of claim 19 wherein the bottom edge of the front panel is spaced above the bottom edge of the back panel.

21. The nozzle of claim 20 further comprising; in combination: a base portion having an upper surface, a lower surface, and a nozzle opening, with the upper surface of the base portion abutting a member, with the wiper and nozzle portions being secured to the lower surface of the base portion; and a seal on the upper surface for engaging the member and formed by the wiper and nozzle portions extending through the nozzle opening.

22. The nozzle of claim 21 wherein the base portion includes means for removable attachment to the member having at least a first hole comprising, in combination: at least a first stud for slideable receipt in the hole, with the first stud extending from the upper surface of the base portion; and means integrally formed with the stud for removably holding the stud in the hole, with the stud being removable from the hole without the use of tools.

23. An assembly for rotation by a surface cleaning machine about an axis comprising, in combination: a block connectable to the surface cleaning machine for rotation about the axis, with the block including an upper surface; at least a first nozzle rotatable with the block for picking solution up from the surface to be cleaned; a vacuum ring secured to the upper surface of the block for rotation therewith and having an inner sidewall concentric to the axis, an outer sidewall concentric to the axis at a greater distance from the axis than the inner sidewall, and an annular interconnecting portion extending radially from the axis and interconnecting the inner and outer sidewalls, with the inner and outer sidewalls and the annular interconnecting portion forming a channel therebetween, with the outer sidewall having an upper edge; means for sealing the channel relative to the surface cleaning machine, with the sealing means including a first seal mounted on one of the upper edge of the outer sidewall and the surface cleaning machine and rotatably abutting with the other of the upper edge of the outer sidewall and the surface cleaning machine; at least a first opening formed in the interconnecting portion; and at least a first tube extending between the first opening in the vacuum ring and the first nozzle for conveyance of the solution from the nozzle to the surface cleaning machine.

24. The assembly of claim 23 wherein the nozzle is movable relative to the block; and wherein the tube is formed in the shape of a Z for biasing the nozzle downward relative to the block.

25. The assembly of claim 23 wherein a volume is defined by the inner sidewall, the block and the surface cleaning machine, with the inner sidewall including a lower edge, with the sealing means further including a second seal sandwiched between the lower edge of the inner sidewall and the block.

* * * * *